US006575238B1

(12) United States Patent
Yokley

(10) Patent No.: US 6,575,238 B1
(45) Date of Patent: Jun. 10, 2003

(54) BALL AND PLUG DROPPING HEAD

(75) Inventor: John M. Yokley, Kingwood, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 09/943,701

(22) Filed: Aug. 31, 2001

Related U.S. Application Data

(60) Provisional application No. 60/292,049, filed on May 18, 2001.

(51) Int. Cl.[7] ..... E21B 23/03

(52) U.S. Cl. ..... 166/75.15; 166/76.1

(58) Field of Search ..... 166/75.15, 70, 166/284, 291, 379, 381, 76.1

(56) References Cited

U.S. PATENT DOCUMENTS

| | | | | |
|---|---|---|---|---|
| 4,854,383 A | | 8/1989 | Arnold et al. | |
| 5,236,035 A | | 8/1993 | Brisco et al. | |
| 5,758,726 A | * | 6/1998 | Streich et al. | 166/379 |
| 5,960,881 A | * | 10/1999 | Allamon et al. | 166/291 |
| 6,142,226 A | * | 11/2000 | Vick | 166/120 |
| 6,182,752 B1 | | 2/2001 | Smith, Jr. et al. | |
| 6,390,200 B1 | * | 5/2002 | Allamon et al. | 166/376 |

OTHER PUBLICATIONS

Weatherford's Liner Hanger Systems Catalog dated 1997 on p. 23.

Westherford's article in JPT Aug. 2001.

Smith Services 1999–2000 General Catalog for the Lindsey Group, p. 29.

Baker Oil Tools General Catalog (Completion Systems) 1998, p. 62.

TIW's General Catalog, 1997, p. 11.

* cited by examiner

*Primary Examiner*—Frank Tsay
(74) *Attorney, Agent, or Firm*—Browning Bushman, P.C.

(57) ABSTRACT

There is disclosed a ball and plug dropping head which includes a housing having an inlet at its upper end and an outlet at its lower end, and passages extending downwardly within the housing at circumferentially spaced locations, each to receive a ball or plug. A lateral opening connects the inlet with each passage beneath a removable plug closing the upper end of each passage, and valves are mounted in the housing each to close the passage beneath the lateral opening and thus beneath a ball on plug in the passage.

2 Claims, 7 Drawing Sheets

BALL AND PLUG DROPPING HEAD

This application claims the benefit of provisional application 60/292,049 filed May 18, 2001.

This invention relates to a head suspended from a top drive for use in sequentially dropping balls and plugs into a liner suspended from the head. More particularly, it relates to the use of such equipment in cementing the liner within the outer casing, such as disclosed for example in Provisional Application No. 60/292,049 filed May 18, 2001, and assigned to the assignee of this application, wherein the one or more balls and wiper plugs are to be dropped onto a seat within the liner to actuate certain parts for the purpose of hanging the liner in the outer casing, followed by the dropping of pump down plugs through the liner for pumping cement beneath them into the annulus between the liner and outer casing.

In previous heads of this type, the balls and wiper plugs were mounted in individual manifolds with each having an opening onto a bore leading to the equipment to be actuated. As will be appreciated, this increased greatly the vertical height of the equipment beneath the top drive, thus making it that much more inaccessible, not only during loading and releasing of the balls and pump down plugs, but also in obtaining visual access to the interior of each manifold in which the plugs and balls were located.

U.S. Pat. Nos. 6,182,752 and 6,206,095 allege to solve the problem of excess height by means of heads of such construction as to permit the balls and plugs to be mounted and dropped from essentially the same vertical location beneath the top drive. Nevertheless, their construction is complicated and requires large internal rotating parts which increased the possibility of leakage and other need for repair.

It is therefore the general object of this invention to provide such a head in which the balls and plugs are mounted on generally the same level, but which does not include the large rotating parts and other mechanisms increasing the risk of repair and replacement.

This and other objects are accomplished, in accordance with the illustrated embodiments of this invention, by a housing having an inlet adapted to be fluidly connected in line with the lower end of a top drive, an outlet generally aligned with the inlet, and passages extending downwardly within the housing at circumferentially spaced locations. Each passage has an upper end opening to the side of the inlet and a lower end connecting with the outlet, and lateral openings in the housing each connect the inlet with a passage. A closure member is removably mounted in the upper end of each passage to permit a ball or plug to be installed therein, and plug valves are mounted in the housing each for opening and closing an opening beneath the lateral passage connecting thereto so as to support the ball or plug, when closed, and permit it to pass therethrough, when open. Circulating fluid may pass downwardly through an open passage when a ball or plug is not in the passage.

BRIEF DESCRIPTION OF THE DRAWINGS

In the drawings, wherein like reference characters are used throughout to designate like paths.

Figure 1A:
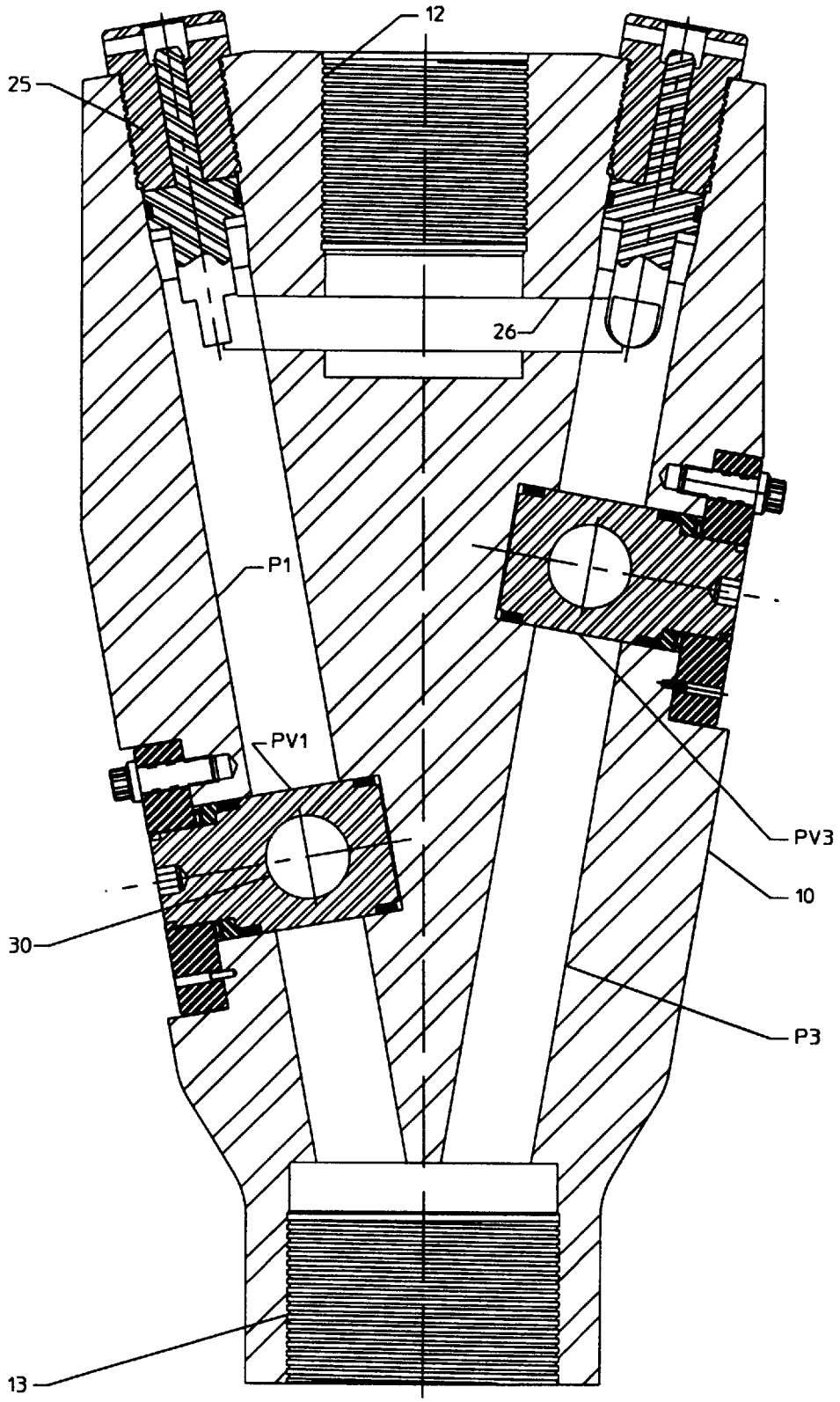
FIG. 1A is a vertical cross-sectional view of the head itself.
Figure 1B:
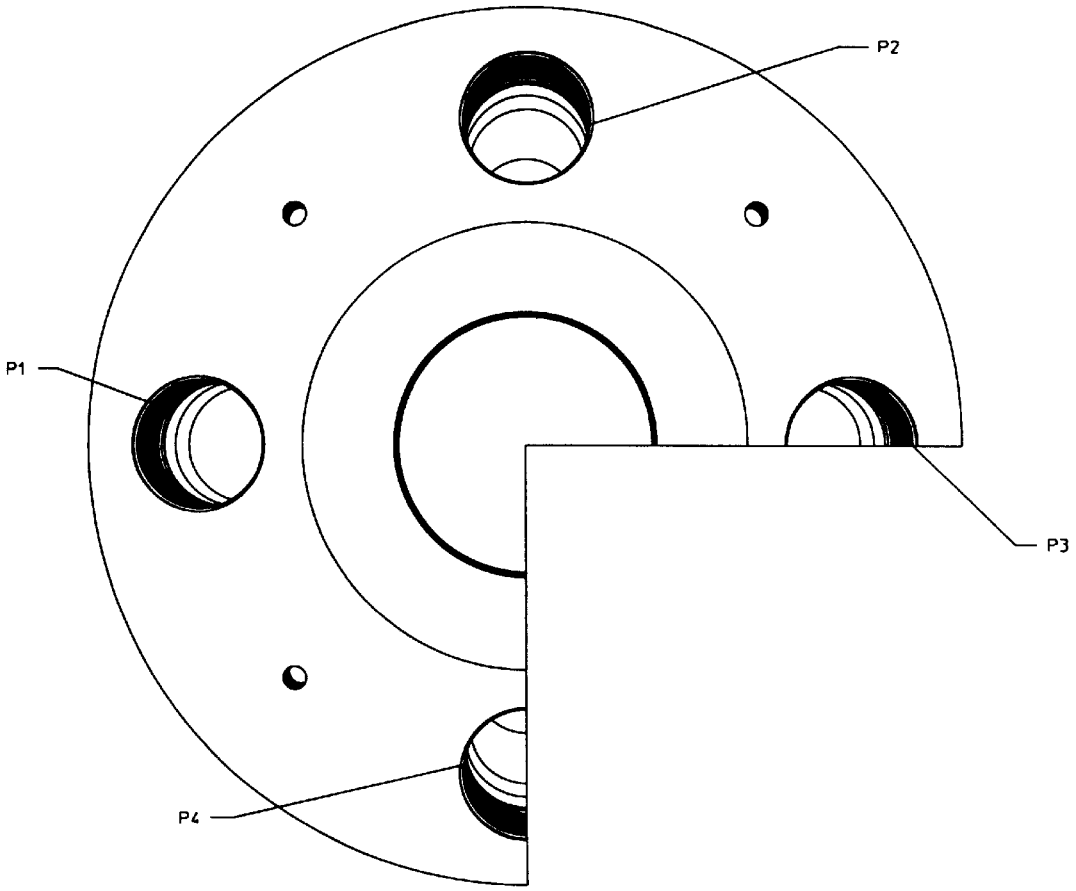
FIG. 1B is a top view of the head.
Figure 1C:
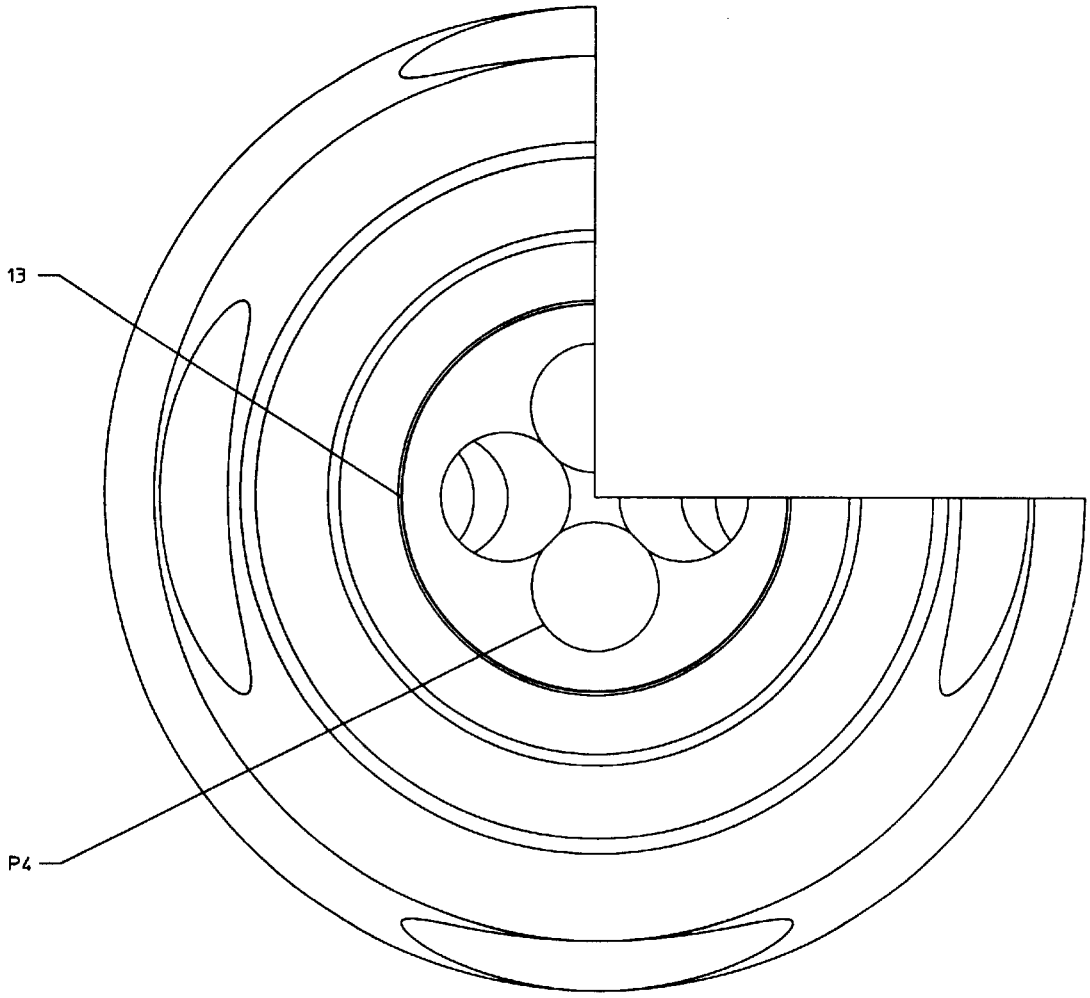
FIG. 1C is a bottom view of the head.
Figure 1D:
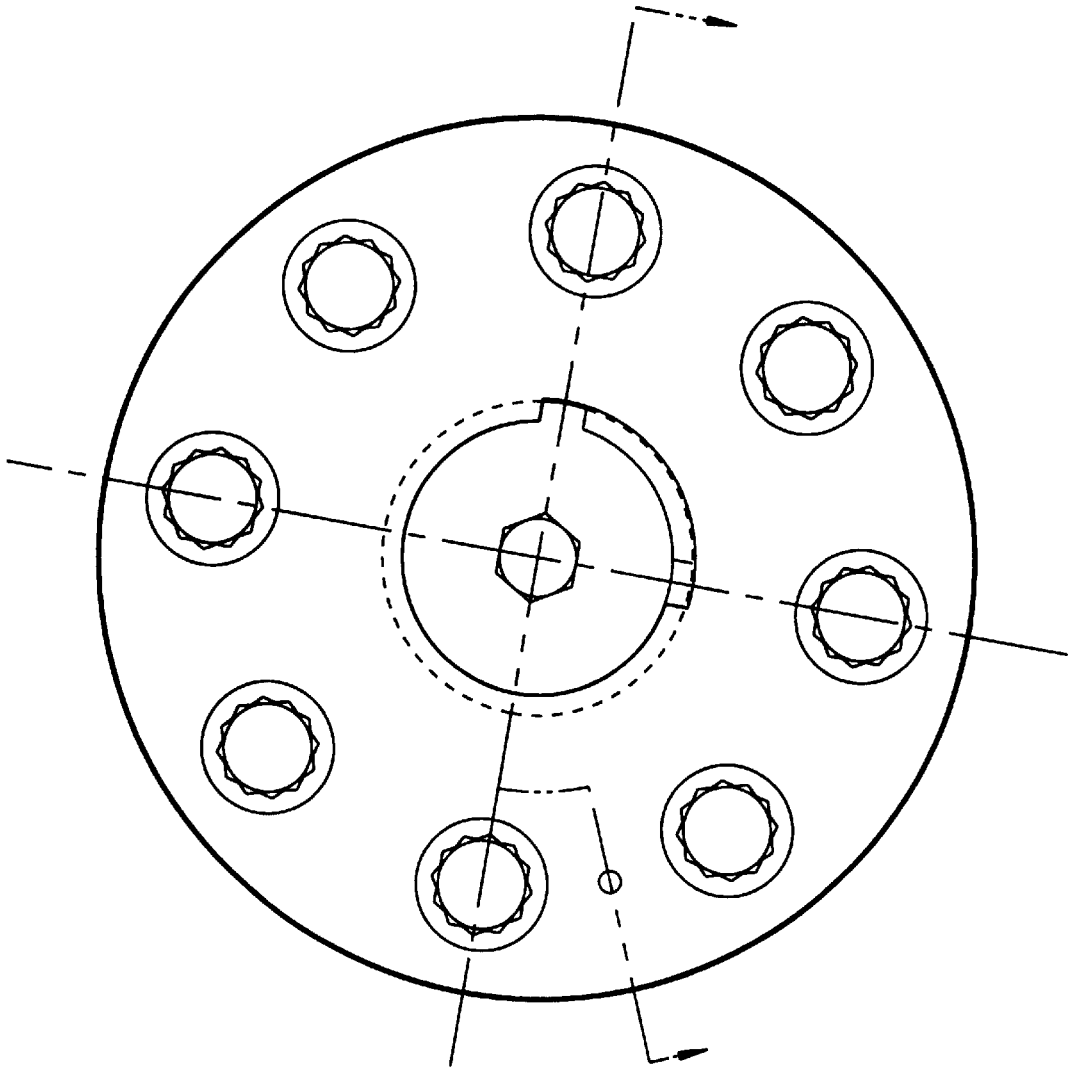
FIG. 1D is a view of a part of the head.

With reference now to the details of the drawings, the head 10 comprises a housing 11 having a vertical opening 12 in its upper end to form an inlet and a vertical opening 13 in its opposite lower end to form an outlet, the openings being generally vertically aligned. The upper opening is threadedly connected to a tubular member 14 whose upper end is threaded for connection with a top drive.

Intermediate the upper and lower ends of the member, 4 is a Kelly valve 16 installed for opening or closing its bore 15. When closed, the valve allows cement to be supplied to the bore 15 through one or more side openings 16 in member 14 beneath the Kelley valve.

The member 14 is installed on a swivel 20 which has openings therethrough aligned with openings 16 in fittings 17 leading to the bore 15 of the member. As well known in the art, this permits relative rotation between the swivel and tubular member so that the tubular member and cementing truck are fluidly connected during relative rotation.

The lower end opening 13 or outlet in the head is threadably connected to the upper end of a sub 21 having a bore 22 therethrough adapted to be connected with the liner or other tubular member suspended therefrom. A "flag" 23 is mounted on a stem 24 rotatable in the sub for indicating the passage of a ball or plug therethrough.

As shown, the housing is of a generally frustoconical shape and has four passages $P_1$, $P_2$, $P_3$ and $P_4$ extending downwardly and inwardly therethrough to connect at their lower ends with the opening 13. More particularly, these passageways are equally spaced apart about the center line of the housing, and thus to opening 12, to connect at their lower ends with a common opening 21A in the upper end of the sub 21.

The upper end of each passage is adapted to receive a closure member 25, the threaded connection between each closure member and its passage enabling the closure member to be selectively removed or installed. The housing also has a lateral openings 26 connecting the inlet 12 with one of the passages $P_1$, $P_2$, $P_3$ and $P_4$ beneath the closure member therefor.

Each passage $P_1$, $P_2$, $P_3$ and $P^4$ is in turn open and closed by means of through bore plug valves $PV_1$, $PV_2$, $PV_3$, and $PV_4$ installed in the housing beneath the lateral openings 26, and vertically staggered to accommodate the valves. These valves of course control the passage of a plug or a ball as well as circulating fluid through the top drive, the head and into the liner below it. Thus, with the valves controlled in the manner to be described, circulation of the fluid may be continuous through at least one passage, even though the individual passages are closed to contain balls or wiper plugs.

As shown, each plug valve comprises a body having an opening 30 therethrough adapted, upon rotation of the body between its alternate positions, for alignment with or across a passage. These valve bodies may of course be rotated in any suitable manner and are held in place by a mounting plate MP bolted to the outside of the housing.

Figure 2A:
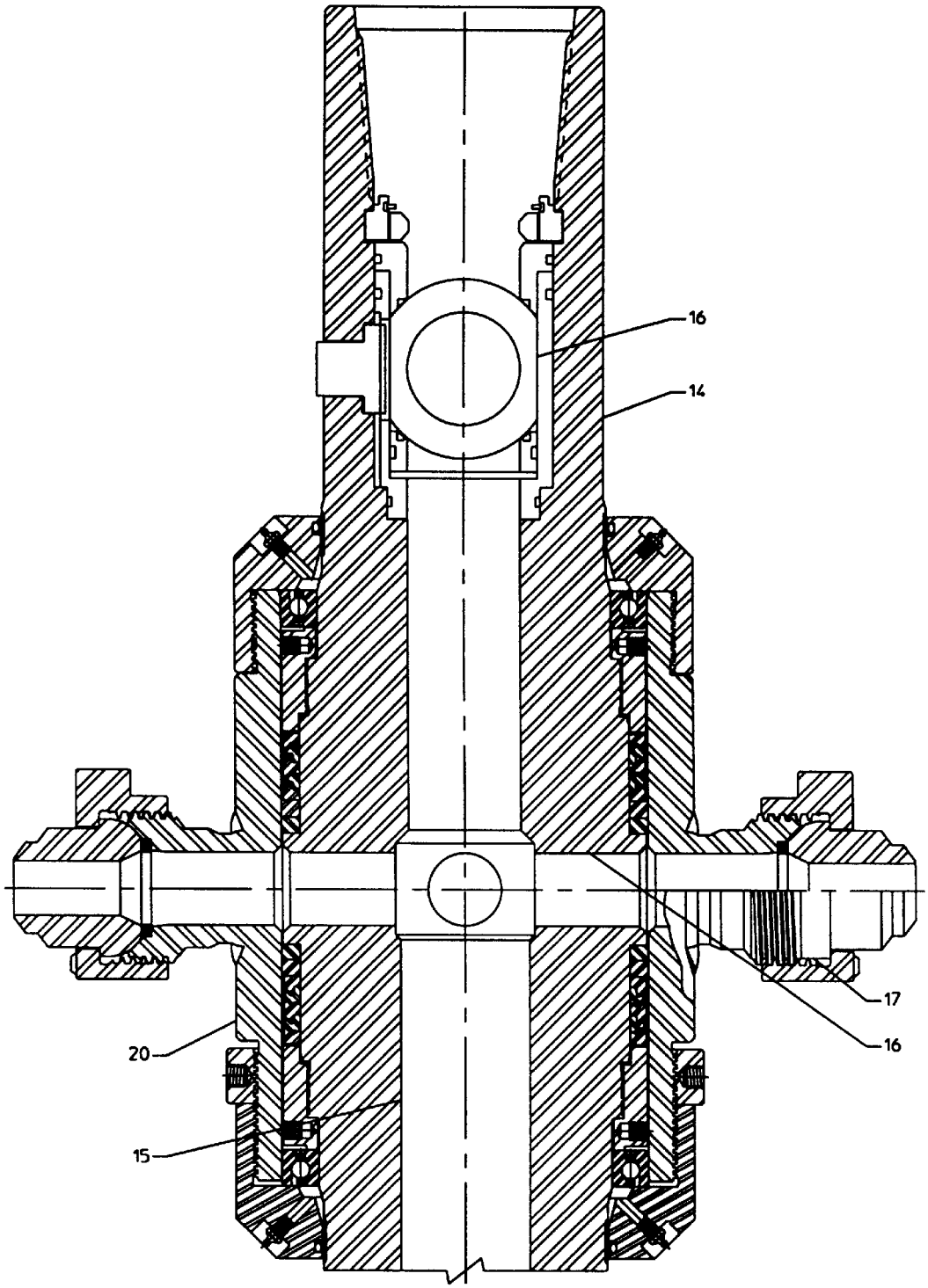
FIG. 2 comprises FIGS. 2A, 2B and 2C and is another, enlarged vertical sectional view of the head installed between a cementing swivel and a lower indication sub connecting to the work string, and showing the balls and plugs in the passages in position to be dropped.
Figure 2B:
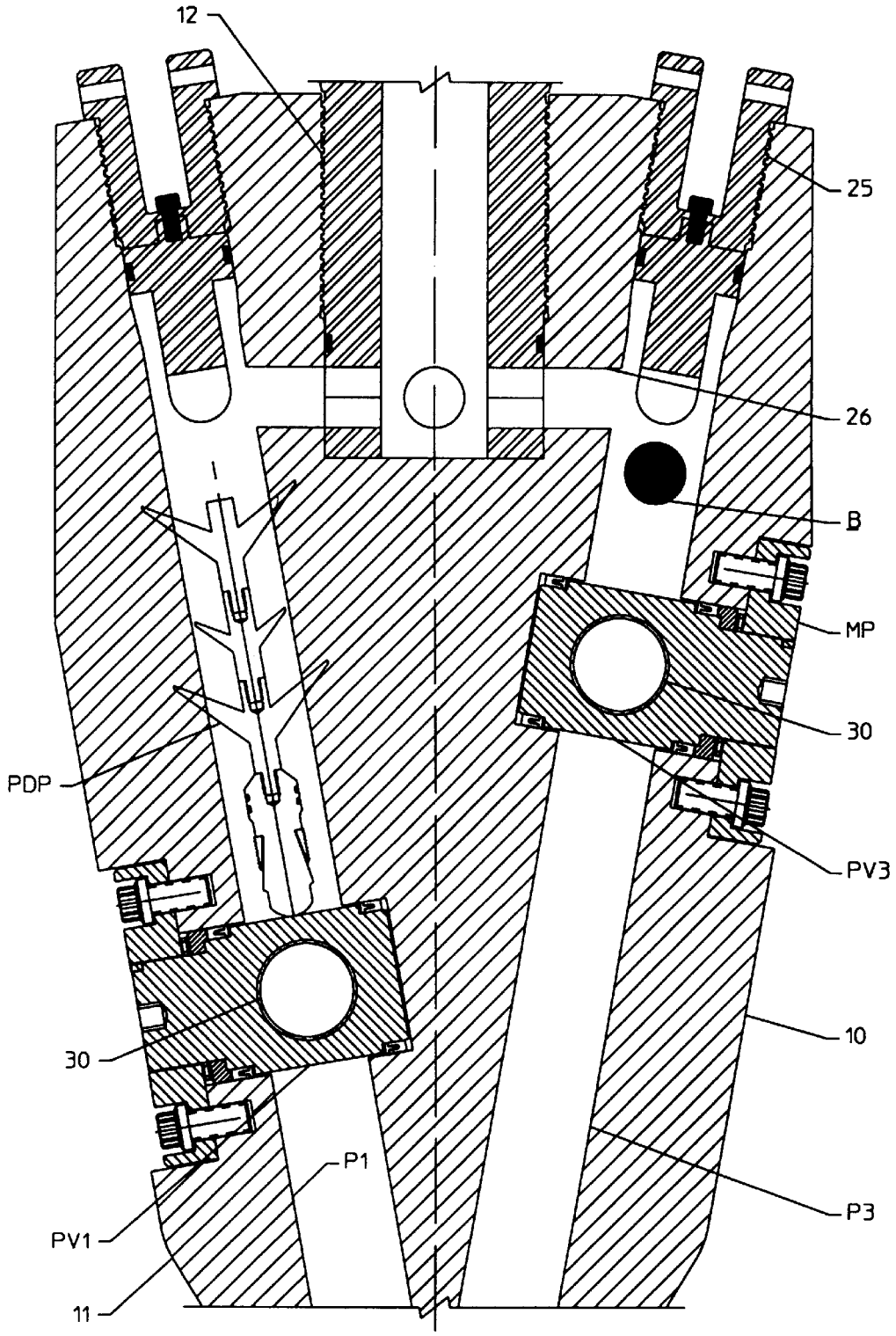
Figure 2C:
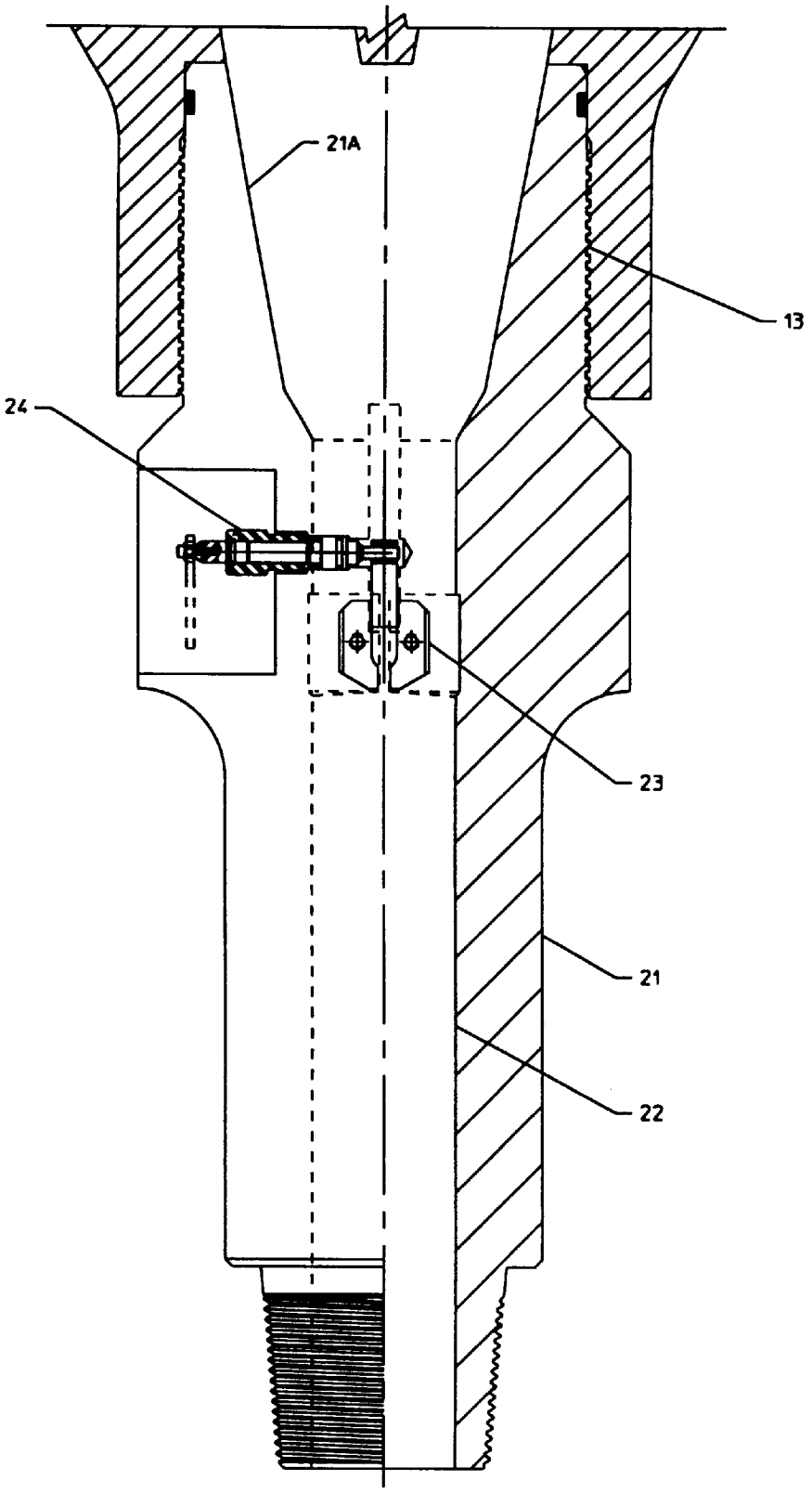

As indicated in FIG. 2, one of the passages may receive a ball B between the top closure member and valve, while another passage may receive a pump down plug PDP. One of the other passages may be used to receive a ball or a plug, depending on the use of the balls and plugs in the system in which the head is installed. The fourth passage may be left open for enabling fluid to be freely circulated downwardly therethrough on a continuous basis.

A plug or a ball may be installed in a passage by removal of the closure member 25, which provides easy visual access to the passage to determine if the ball or plug in place or has been dropped downwardly. Each ball drops freely by virtue of its own weight when the plug valve in its passage is opened. The pump down plug, however, has wiper blades on it which are flexibly engaged with the passage, so that the downward movement of the wiper blade into the liner may be assisted by the passage of fluid through the ports connecting with the passage. The fourth passage may receive either a plug or a ball, depending on the needs of the system in which the head is installed or left open for free downward flow of the circulating fluid.

As will be understood, the only parts of the head requiring movement, and thus bearings and seals, are the plug valves PV for the individual passages. Closure of the plug valve in the three passages may facilitate downward pressure through the fourth passage when its plug valve is open, thus forcing the ball or plug downwardly into the liner.

As shown, each plug valve is mounted for rotation within its passage by means of a mounting plate MP bolted to a recessed portion of the outer side of the head and engaging an annular shoulder about the plug valve member.

What is claimed is:

1. A ball and plug dropping head for use in sequentially dropping one or more balls and plugs into a liner of a liner hanger system, comprising:

a housing having an inlet at its upper end adapted to be fluidly connected in line with the lower end of a top drive, an outlet generally aligned with the inlet and adapted to be connected to the upper end of a running tool, and passages extending downwardly within the housing at circumferentially spaced locations, each passage having an upper end to the side of the upper end of the inlet and a lower end connecting with the outlet, lateral openings in the housing each connecting the inlet with a passage, a closure member removably mounted in the upper end of each passage to permit a ball or plug to be installed therein, and valves mounted in the housing each for opening and closing a passage beneath the lateral opening connecting thereto so as to support ball or plug when closed and permit the ball or plug to pass therethrough, and circulating fluid to pass downwardly therethrough when neither a ball nor plug is in the passage.

2. As in claim 1, wherein each valve is removably mounted in a side opening in the housing to permit it to be installed and removed from outside of the housing.

* * * * *